US009941608B2

(12) United States Patent
Zebhauser et al.

(10) Patent No.: US 9,941,608 B2
(45) Date of Patent: Apr. 10, 2018

(54) PLUG CONNECTOR ARRANGEMENT WITH COMPENSATION SLEEVE

(71) Applicant: ROSENBERGER HOCHFREQUENZTECHNIK GMBH & CO. KG, Fridolfing (DE)

(72) Inventors: Martin Zebhauser, Laufen (DE); Till Bredbeck, Traunstein (DE); Gunnar Armbrecht, Muhldorf am Inn (DE); Stephan Kunz, Chieming (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/543,607

(22) PCT Filed: Jan. 21, 2016

(86) PCT No.: PCT/EP2016/000105
§ 371 (c)(1),
(2) Date: Jul. 14, 2017

(87) PCT Pub. No.: WO2016/120005
PCT Pub. Date: Aug. 4, 2016

(65) Prior Publication Data

US 2018/0013214 A1 Jan. 11, 2018

(30) Foreign Application Priority Data

Jan. 30, 2015 (DE) ..... 20 2015 000 750 U

(51) Int. Cl.
*H01R 9/05* (2006.01)
*H01R 13/6473* (2011.01)
(Continued)

(52) U.S. Cl.
CPC ..... *H01R 9/0518* (2013.01); *H01R 9/0524* (2013.01); *H01R 13/6473* (2013.01);
(Continued)

(58) Field of Classification Search
CPC ..... H01R 9/0518; H01R 9/05; H01R 9/0524; H01R 24/40; H01R 2103/00; H01R 13/6473; H01R 43/05
See application file for complete search history.

(56) References Cited

U.S. PATENT DOCUMENTS 2,870,420 A 1/1959 Malek
3,076,169 A 1/1963 Blaisdell
(Continued)

FOREIGN PATENT DOCUMENTS

EP 1858123 A2 4/2007

*Primary Examiner* — Jean F Duverne
(74) *Attorney, Agent, or Firm* — Robert Curcio; DeLio, Peterson & Curcio LLC

(57) ABSTRACT

A plug connector arrangement having a plug connector and a cable connected thereto, at least one inner conductor and an outer conductor surrounding the inner conductor, wherein the outer conductor of the cable is electrically connected to an outer conductor housing of the plug connector. The plug connector arrangement additionally has a sleeve part which surrounds the inner conductor, has approximately the same inner diameter (D) as the outer conductor (34) of the cable, adjoins a front axial end (A) of the outer conductor, and continues a shielding of the inner conductor in the direction of the front cable end.

8 Claims, 1 Drawing Sheet

(51) Int. Cl.
*H01R 24/44* (2011.01)
*H01R 43/05* (2006.01)
*H01R 103/00* (2006.01)

(52) U.S. Cl.
CPC ..... *H01R 24/44* (2013.01); *H01R 43/05* (2013.01); *H01R 2103/00* (2013.01)

(56) References Cited

U.S. PATENT DOCUMENTS

| | | | | | |
|---|---|---|---|---|---|
| 3,103,548 | A | | 9/1963 | Concelman | |
| 3,295,095 | A | | 12/1966 | Kraus | |
| 4,869,690 | A | * | 9/1989 | Frear | H01R 9/05 439/585 |
| 5,127,843 | A | | 7/1992 | Henry | |
| 5,354,217 | A | | 10/1994 | Gabel | |
| 5,607,325 | A | * | 3/1997 | Toma | H01R 9/0524 439/578 |
| 5,803,767 | A | * | 9/1998 | Matsumoto | H01R 24/40 439/585 |
| 5,823,803 | A | * | 10/1998 | Majors | H01R 9/0518 439/98 |
| 6,024,609 | A | * | 2/2000 | Kooiman | H01R 24/40 411/433 |
| 8,450,610 | B2 | * | 5/2013 | Alvelo | H01B 7/18 174/84 R |
| 2003/0087553 | A1 | | 5/2003 | Tang | |
| 2006/0264099 | A1 | | 11/2006 | Morikawa | |

* cited by examiner

PLUG CONNECTOR ARRANGEMENT WITH COMPENSATION SLEEVE

BACKGROUND OF THE INVENTION

1. Field of the Invention

The invention relates to a plug connector arrangement which consists of a plug connector and a cable connected thereto. The cable has at least one inner conductor and an outer conductor surrounding the inner conductor, wherein the outer conductor is electrically connected with an outer conductor housing of the plug connector.

The plug connector has a plug-side end for connecting the plug connector with a mating plug connector and a cable-side end to which the cable is attached (preferably inseparably by means of soldering or crimping). The inner conductor of the cable is thereby connected electrically with an inner conductor part of the plug connector such as a contact pin or a contact socket and the outer conductor of the cable is connected electrically with the outer conductor housing of the plug connector surrounding the inner conductor part, so that preferably a continuous shielding is formed from the cable to the plug-side end of the plug connector.

2. Description of Related Art

In order to create the connection between the plug connector and the cable, it is known for the outer conductor housing, which consists of an electrically conductive material and is, at least in sections, sleeve-formed, to be crimped or pressed together with an axial end section of the outer conductor. For this purpose, during the manufacture of the plug connector arrangement the cable is stripped, or sections of the cable sheathing are removed, at its front end, so that the outer conductor is exposed. The outer conductor housing surrounding the outer conductor is then pressed together with the outer conductor.

However, it has been found that a plug connector arrangement manufactured in the conventional manner described is often not optimally electrically matched in the region of the connection between the plug connector and the cable. In particular, undesired deviations from the intended characteristic impedance can occur in the connection region, for example an undesired increase in impedance.

SUMMARY OF THE INVENTION

In view of the described problems it is the object of the present invention to provide a stable, high tensile strength connection between the plug connector and the cable which is also optimally electrically matched, preferably over its entire extension in the longitudinal direction of the cable.

This problem is solved by means of a plug connector arrangement according to the independent claims. Advantageous further developments of the invention are described in the dependent claims.

The above and other objects, which will be apparent to those skilled in the art, are achieved in the present invention which is directed to a plug connector arrangement comprising a plug connector and a cable connected thereto, comprising at least one inner conductor and an outer conductor surrounding the inner conductor, wherein the outer conductor of the cable is electrically connected to an outer conductor housing of the plug connector, further comprising a sleeve part surrounding the inner conductor which has approximately the same inner diameter (D) as the outer conductor of the cable, which adjoins a front axial end (A) of the outer conductor and which continues a shielding of the inner conductor in the direction of the front cable end; and a supporting sleeve surrounding the inner conductor on the side of the sleeve part facing away from the plug connector, wherein the outer conductor is folded back over the supporting sleeve, wherein the outer conductor housing includes a sleeve section to receive an end of the cable, wherein a wall of the sleeve section lies radially on the outside of the sleeve part and the supporting sleeve, having several crimped connections between the sleeve section of the outer conductor housing and the cable on the level of the sleeve part and on the level of the supporting sleeve.

The sleeve part may be a cylinder-barrel-formed sleeve. The outer conductor is in the form of a braid, for example a wire braid, and/or the inner conductor is in the form of a core surrounded by a dielectric or one or more insulated wires.

The cable is preferably a coaxial cable, a shielded twisted-pair cable, a shielded star quad cable or similar.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
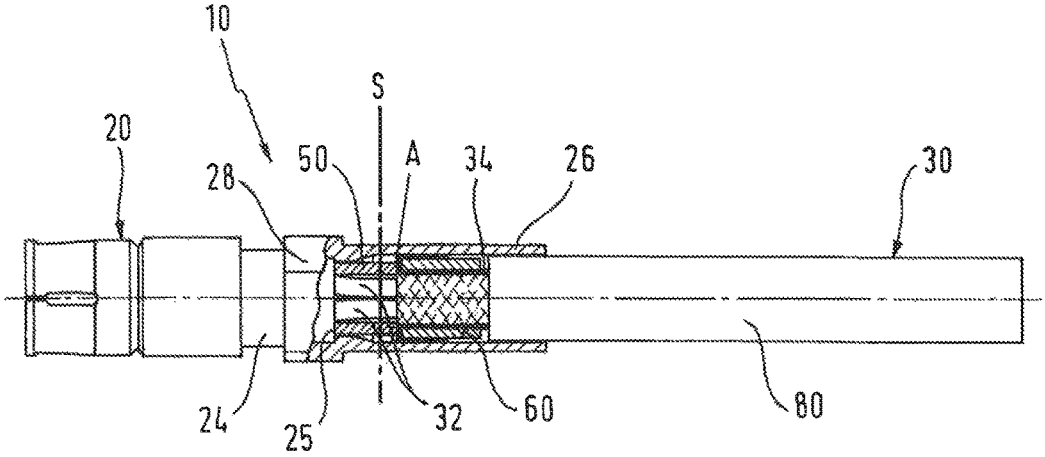
FIG. 1 shows a schematic side view of a plug connector arrangement according to the invention, partially represented as a longitudinal section.

In describing the preferred embodiment of the present invention, reference will be made herein to FIGS. 1-2 of the drawings in which like numerals refer to like features of the invention.

The plug connector arrangement according to the invention has a sleeve part surrounding the inner conductor which adjoins the front axial end of the outer conductor and thus continues the outer conductor (or an inner conductor shielding) in an axial direction (in the direction of the plug-side end of the plug connector). It is thereby important that the sleeve part has approximately the same inner diameter as the outer conductor of the cable. In other words, the sleeve part surrounds the inner conductor of the cable in an outer-conductor-free region which is provided at the front cable end in order to make possible a connection of the inner conductor with the inner conductor part of the plug connector. Preferably, the sleeve part is provided between the front axial end of the outer conductor and an axial limit stop of the plug connector.

The invention is based on the knowledge that, in order to achieve an impedance which remains the same in the longitudinal direction of the cable without changing the cable geometry, the distance between the inner conductor and the outer conductor of the cable must also substantially remain the same. For example, an increase in the distance between the inner conductor and outer conductor of the cable generally leads to an inductive region or to an undesired increase in impedance. In conventional plug connector arrangements, an undesired abrupt change in the distance between the inner conductor and its shielding generally occurs at the front axial end of the outer conductor whereas, according to the invention, as a result of the sleeve part the shielding is also continued in the region of the front axial end of the outer conductor at a constant distance from the inner conductor, so that no change in impedance occurs in this region.

Preferably, the ratio between the inner diameter of the sleeve part and the inner diameter of the outer conductor lies between 0.9 and 1.2, particularly preferably between 0.95 and 1.1, in particular between 0.98 and 1.05, so that the outer conductor transitions at its axial front end in a practically step-free manner into the sleeve part or actually lies against this in a practically step-free manner. In this way, an abrupt change in the distance between the inner conductor and its shielding at the front end of the outer conductor is reliably prevented.

The sleeve part can be formed in a single part as a closed cylinder-barrel-formed sleeve and in this case, starting out from the front cable end, is pushed over the inner conductor (or over several inner conductors) in the direction of the front axial end of the outer conductor. Alternatively, the sleeve part can also be formed as an open sleeve which is only closed by means of a pressing operation when attaching the sleeve, and then surrounds the inner conductor on all sides. As a further alternative, the sleeve part can consist of two or more sleeve shells which are placed on the inner conductor from different sides. Preferably, the sleeve part is in the form of a substantially cylinder-barrel-formed tube section or tube and consists of a conductive material such as a metal, in particular copper, silver or similar.

In addition to the sleeve part, the cable can have a supporting sleeve surrounding the inner conductor on the side of the sleeve part facing away from the plug connector. Particularly if the supporting sleeve is arranged radially on the outside of the outer conductor, it has proved advantageous if the inner diameter of the supporting sleeve is somewhat larger than the inner diameter of the sleeve part, so that the supporting sleeve can be fitted onto the outside of the outer conductor without any problem, while, whereas the sleeve part can be fitted onto the outside of the inner conductor, it cannot be fitted onto the outside of the outer conductor. This ensures that a substantially constant distance between the inner conductor and the shielding is maintained over the entire length of the cable end. Unlike the supporting sleeve, the sleeve part is arranged axially next to the outer conductor, but preferably not in the same radial plane as the outer conductor, so that the outer conductor and the sleeve part do not overlap in the longitudinal direction of the cable.

The supporting sleeve can serve to hold and fix in place the front end of the outer conductor, in particular if the outer conductor is in the form of a wire braid or similar. In this connection it has proved advantageous if the plug-connector-side end of the supporting sleeve substantially coincides with the axial front end of the outer conductor in the longitudinal direction of the cable, so that the supporting sleeve supports and holds the outer conductor as far as its front axial end.

In order to achieve an optimal electrical and mechanical connection between the outer conductor, the supporting sleeve and the outer conductor housing it has proved advantageous for the outer conductor to be folded back over the supporting sleeve. In this case, a particularly durable and stable crimped connection between the outer conductor, preferably in the form of a wire braid, and the supporting sleeve or the outer conductor housing can be created by pressing.

Preferably, the distance between the cable-side end of the sleeve part and the plug-connector-side end of the supporting sleeve or the outer conductor folded back over this is less than 2 mm, in particular less than 1 mm. It is particularly advantageous if the cable-side end of the sleeve part lies directly against the plug-connector-side end of the supporting sleeve or the outer conductor folded back over this. In this case, an electrical connection between the outer conductor and the outer conductor housing is not only established directly, but also indirectly via the sleeve part.

In a particularly preferred embodiment of the invention, the sleeve part and/or the supporting sleeve are, at least in sections, in the form of a cylinder-barrel-formed sleeve such as a crimp sleeve, which can be formed either as a single part or can consist of several cylinder shell parts. The inner diameter of the sleeve part can be matched to the outer diameter of an insulation surrounding the inner conductor(s) and/or the inner diameter of the supporting sleeve can be matched to the outer diameter of the outer conductor.

As already indicated, the outer conductor housing preferably includes a sleeve section to receive the cable end, wherein a wall of the sleeve section lies radially on the outside of the sleeve part and/or the supporting sleeve. In other words, the sleeve section is designed to accommodate the cable end at least as far as the supporting sleeve. On the one hand, this ensures a continuous shielding of the inner conductor. On the other hand, it is possible, by simple means, to press the sleeve section together with the cable by applying a radial pressing force from the outside to the wall of the sleeve section. As a result, the cable is held to the plug connector in a manner resistant to tensile force.

According to a particularly important aspect of the invention, the plug connector arrangement has one or more crimped connections between the sleeve section of the outer conductor housing and the cable on the level of the sleeve part and/or on the level of the supporting sleeve. It has proved particularly advantageous to provide a first crimped connection in the region of the sleeve part and at least one second crimped connection in the region of the supporting sleeve. On the one hand, this guarantees a good electrical contact and a stable mechanical connection between the outer conductor and the outer conductor housing. On the other hand, it is ensured that both the supporting sleeve and also the sleeve part are fixed in place, both relative to the outer conductor and also relative to the inner conductor.

In order to achieve optimal characteristic impedance behavior it has proved expedient for the plug-connector-side end of the sleeve part to rest directly against an axial limit stop of the outer conductor housing. Starting out from the axial limit stop, the outer conductor housing preferably has an inner diameter in the direction of the plug-side end of the plug connector which substantially corresponds to that of the outer conductor of the cable. The distance between the axial limit stop of the plug connector and the front axial end of the outer conductor preferably substantially corresponds to the axial dimension of the sleeve part.

In order to achieve an economical manufacturability and in order to achieve a comparatively light cable weight it has proved advantageous for the outer conductor to be in the form of a braid such as a wire braid. A wire braid is also particularly suitable for creating a crimped connection and is suitable for folding back over the supporting sleeve.

On the other hand, the inner conductor can be in the form of a core surrounded by a dielectric or one or more insulated wires. For example, one or more inner conductor pairs are provided for the transmission of one or more differential signals via the cable. Two inner conductor pairs can for example run in a star quad configuration. Preferably, all the inner conductors are surrounded by the common outer conductor in the form of a wire braid.

The cable can be a coaxial cable, a shielded twisted-pair cable, a shielded star quad cable or similar. Such cables are generally used to transmit HF signals, wherein in this case an optimal electrical matching is particularly important in order to avoid a distortion of the signal.

The invention is explained in the following description with reference to the enclosed drawings.

The plug connector arrangement 10 according to the invention represented schematically in FIG. 1 consists of a plug connector 20, for example a coaxial plug connector and a cable 30 attached thereto, for example a coaxial cable, a star quad cable or similar.

The plug connector 20 is designed for connection with a mating plug connector, for example a socket part, at its plug-side end, shown on the left in FIG. 1. The cable 30 is attached, in a manner resistant to tensile force, at a cable-side end of the plug connector 20, shown on the right in FIG. 1.

The cable 30 has (in this case, by way of example) a total of four stranded inner conductors 32 in the form of wires, each covered with an insulation. In each case two inner conductors 32 form differential conductor pairs for the transmission of differential signals, for example HF signals or similar. The four inner conductors 32 are surrounded by a common outer conductor 34 in the form of a wire braid which shields the inner conductors 32 from the outside. The wire braid lies against the outside of the wire insulation. The outer conductor 34 is surrounded on the outside, coaxially, by a cable sheathing 80 made of a non-conductive material such as a plastic.

The inner conductors 32 are each electrically connected at their front end facing the plug connector 20 with inner conductor contacts (not shown) of the plug connector 20. The outer conductor 34 is electrically connected at its frontend section facing the plug connector 20 with an outer conductor housing 24 of the plug connector which continues the shielding of the inner conductors 32 as far as the plug-side end of the plug connector 20.

The front cable end is accommodated in a tube-like sleeve section 26 of the outer conductor housing 24 which, starting out from a base section of the outer conductor housing 24, projects on the cable side. The inner diameter of the sleeve section 26 substantially corresponds to the outer diameter of the cable sheathing 30, so that the cable 30 can be introduced into the opening formed by the sleeve section 26.

The cable sheathing 80 is removed at the front end of the cable 30, so that the outer conductor 34 is exposed and can be brought into electrical contact with the wall of the sleeve section 26.

In order to provide better fixing of the front axial end A of the outer conductor 34 and in particular in order to prevent damage to the inner conductor 32 during the manufacture of a crimped connection between the outer conductor 34 and the outer conductor housing 24, a supporting sleeve 60 is provided on a front section of the outer conductor 34.

The wire braid of the outer conductor 34 is folded back over the front end of the supporting sleeve, so that the wire braid of the outer conductor 34 lies against the supporting sleeve 60 on the inside and outside. As a result, the wire braid lying against the front end of the supporting sleeve 60 forms the front axial end A of the outer conductor 34.

As is clearly shown in FIG. 1, a space without outer cable conductor is formed between the axial end A of the outer conductor 34 and a limit stop 25 of the plug connector in which the distance between the inner conductors 32 and the sleeve section 26 is considerable. In conventional plug connector arrangements, this distance between the inner conductor and shielding, which changes abruptly at the frontend A of the outer conductor 34, leads to an inductive region with inadequate electrical matching.

According to the invention, in this space without outer cable conductor a sleeve part 50 consisting of an electrically conductive material is arranged radially on the outside of the inner conductors 32. The inner diameter of the sleeve part D substantially corresponds to the diameter of the outer conductor 34 so that, starting out from the axial end of the outer conductor 34, no abrupt change in the inner diameter of the shielding occurs as far as the plug-connector-side end of the sleeve part 50. The cable-side end of the sleeve part 50 lies directly against the axial end A of the outer conductor 34.

On the other hand, the plug-connector-side end of the sleeve part 60 preferably lies against an axial limit stop 25 of the outer conductor housing 24. Starting out from the limit stop 25, an outer conductor region 28 of the outer conductor housing 24 is provided in which the inner diameter of the outer conductor housing 24 substantially corresponds to the inner diameter D of the outer conductor 34. As a result, the shielding is continued in the direction of the plug-side end of the plug connector at a constant distance from the inner conductors.

Figure 2:
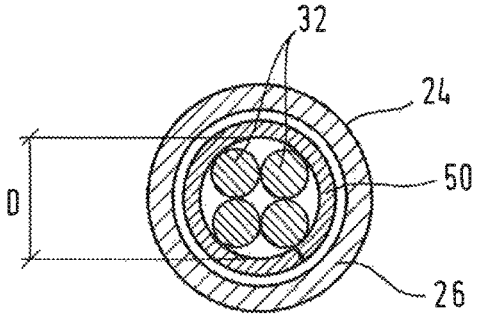
FIG. 2 shows a cross-sectional view through the plug connector arrangement shown in FIG. 1 (sectional plane S).

In FIG. 2, the plug connector arrangement according to the invention is shown in cross section in the sectional plane S running through the sleeve part 50. The four inner conductors 32 surrounded by the sleeve part 50 are clearly shown. The sleeve part 50 is in turn surrounded by the sleeve section 26 of the outer conductor housing 24. The wall of the sleeve section 26 is pressed from outside against the sleeve part 50 by applying a radial pressing force from the outside against the sleeve section 26.

The invention is not limited to the embodiment described. In particular, the sleeve part can also be formed differently. It is in particular important that the sleeve part continues the outer conductor, starting out from its axial end, in the direction of the front cable end, maintaining the distance between the inner conductors and the shielding.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connector arrangement comprising a plug connector and a cable connected thereto, comprising at least one inner conductor and an outer conductor surrounding the inner conductor, wherein the outer conductor of the cable is electrically connected to an outer conductor housing of the plug connector, further comprising a sleeve part surrounding the inner conductor which has approximately the same inner diameter (D) as the outer conductor of the cable, which adjoins a front axial end (A) of the outer conductor and which continues a shielding of the inner conductor in the direction of the front cable end; and a supporting sleeve surrounding the inner conductor on the side of the sleeve part facing away from the plug connector, wherein the outer conductor is folded back over the supporting sleeve, wherein the outer conductor housing includes a sleeve section to receive an end of the cable, wherein a wall of the sleeve section lies radially on the outside of the sleeve part and the supporting sleeve, having several crimped connections between the sleeve section of the outer conductor housing and the cable on the level of the sleeve part and on the level of the supporting sleeve.

2. The plug connector arrangement of claim 1, wherein the sleeve part is a cylinder-barrel-formed sleeve.

3. The plug connector arrangement of claim 1, wherein the cable-side end of the sleeve part lies directly against the axial end (A) of the outer conductor and/or the plug-connector-side end of the sleeve part lies directly against an axial limit stop of the outer conductor housing at which the outer conductor housing has substantially the same inner diameter (D) as the outer conductor of the cable.

4. The plug connector arrangement of claim 1, wherein the outer conductor is in the form of a braid, and/or the inner conductor is in the form of a core surrounded by a dielectric or one or more insulated wires.

5. The plug connector arrangement of claim 1, wherein the cable is a coaxial cable, a shielded twisted-pair cable or a shielded star quad cable or similar.

6. The plug connector arrangement of claim 2, wherein the cable-side end of the sleeve part lies directly against the axial end (A) of the outer conductor and/or the plug-connector-side end of the sleeve part lies directly against an axial limit stop of the outer conductor housing at which the outer conductor housing has substantially the same inner diameter (D) as the outer conductor of the cable.

7. The plug connector arrangement of claim 4, wherein the outer conductor is in the form of a wire braid.

8. The plug connector arrangement of claim 7, wherein the cable is a coaxial cable, a shielded twisted-pair cable, a shielded star quad cable or similar.

* * * * *